United States Patent [19]

Yen

[11] Patent Number: 5,010,790

[45] Date of Patent: Apr. 30, 1991

[54] APPARATUS FOR REMOVING A SOFT STOPPER FROM A CONTAINER

[76] Inventor: Richard C. K. Yen, 1440 E. Comstock Ave., Glendora, Calif. 91740

[21] Appl. No.: 500,991

[22] Filed: Mar. 29, 1990

Related U.S. Application Data

[63] Continuation-in-part of Ser. No. 401,186, Aug. 31, 1989, Pat. No. 4,916,985.

[51] Int. Cl.[5] ..... B67B 7/02

[52] U.S. Cl. ..... 81/3.45; 81/3.35

[58] Field of Search ..... 81/3.45, 3.07, 3.48, 81/3.36, 3.29, 3.35

[56] References Cited

U.S. PATENT DOCUMENTS

| | | | |
|---|---|---|---|
| 2,093,541 | 9/1937 | Bohler | 81/3.45 |
| 4,574,662 | 3/1986 | Jones | 81/3.45 |
| 4,727,779 | 3/1988 | Lee | 3.29/ |

FOREIGN PATENT DOCUMENTS

| | | | |
|---|---|---|---|
| 129300 | 12/1984 | European Pat. Off. | 81/3.29 |

*Primary Examiner*—Roscoe V. Parker

*Attorney, Agent, or Firm*—Thomas I. Rozsa

[57] ABSTRACT

An apparatus for removing a soft stopper such as a cork from a container such as a bottle. The apparatus includes a hollow cylinder having one or more slits along its length and a handle attached to the top of the cylinder. The interior surface of the cylinder includes one or more spiral wound threads having a flat upper surface. The cylinder is inserted between the outer circumference of the cork and the interior wall of the bottle and is rotated so that the threads are embedded in the outer wall of the cork and serve to compress the cork inwardly as the apparatus is screwed into the container. A stop ring serves to limit the penetration of the apparatus into the bottle and when the apparatus has reached its maximum penetration, the apparatus begins to force the cork out of the bottle as the turning motion of the cork continues. Various embellishments serve to enhance the efficiency of operation of the device.

37 Claims, 3 Drawing Sheets

Fig. 1.
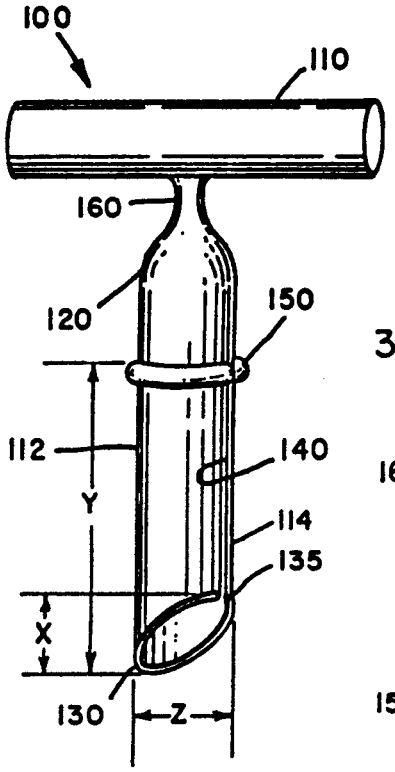
Fig. 2.
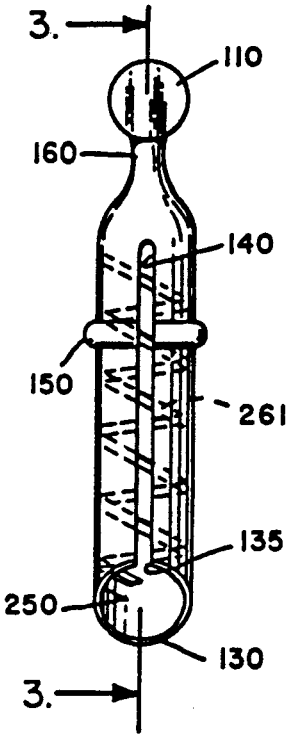
Fig. 3.
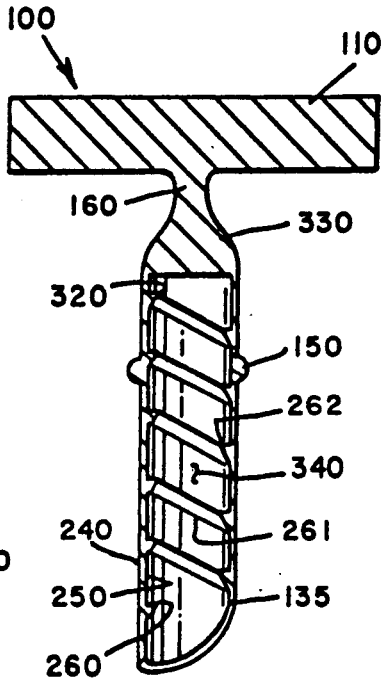
Fig. 4.
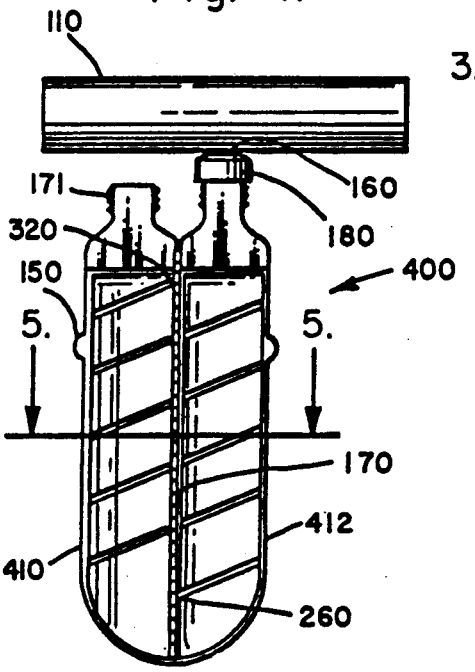
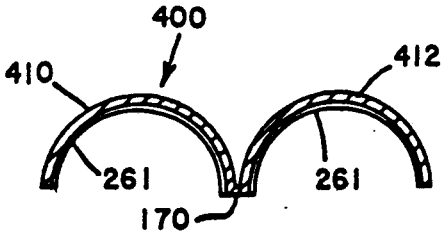
Fig. 5.

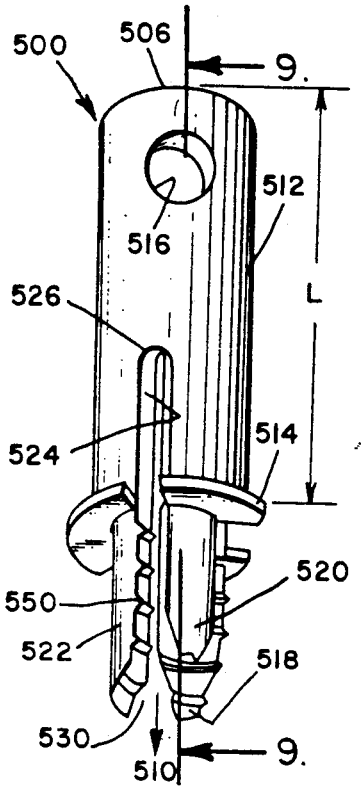
Fig. 6.
Fig. 7a.
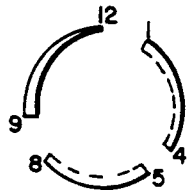
Fig. 7b.
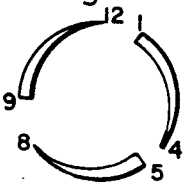
Fig. 8.
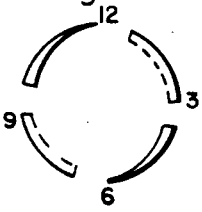
Fig. 9.
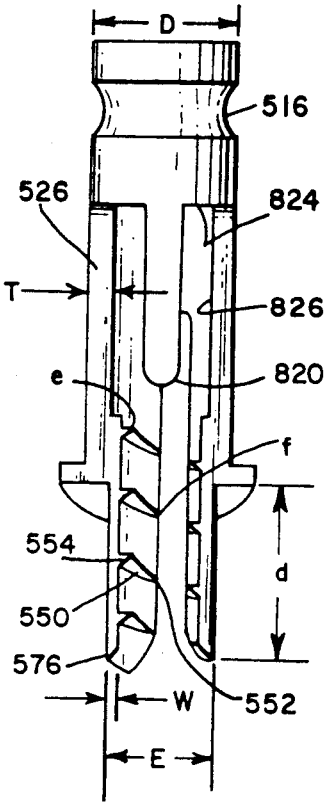
Fig. 10.
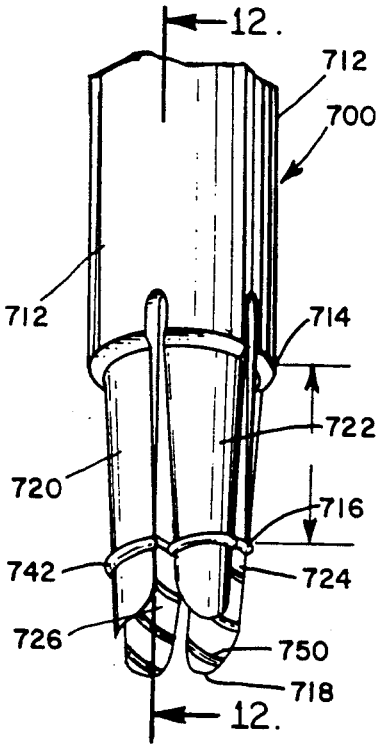
Fig. 11.
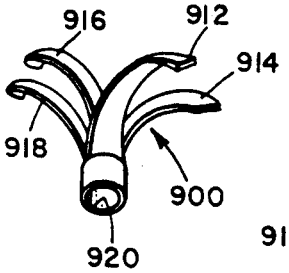
Fig. 12.
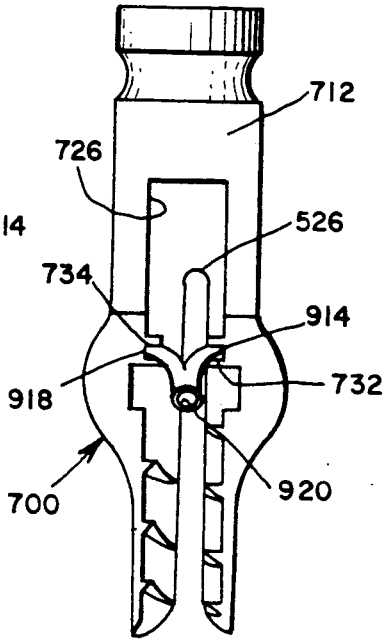

Fig. 14.
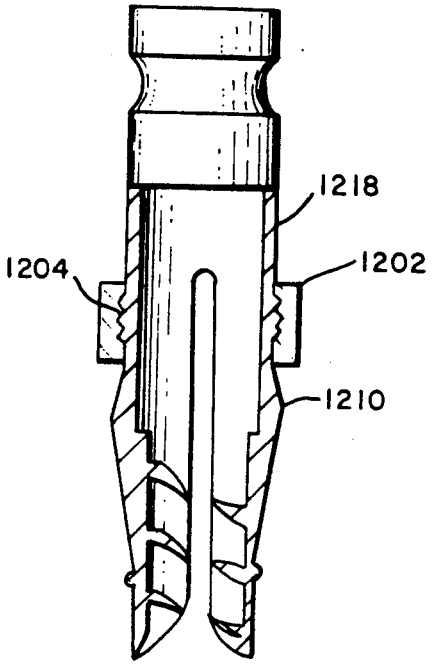
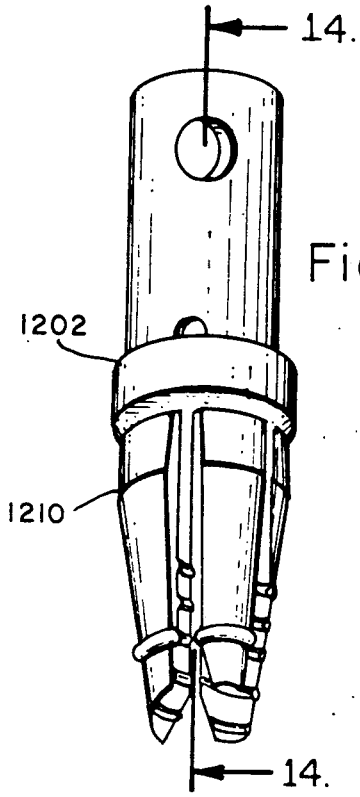
Fig. 13.
Fig. 15.
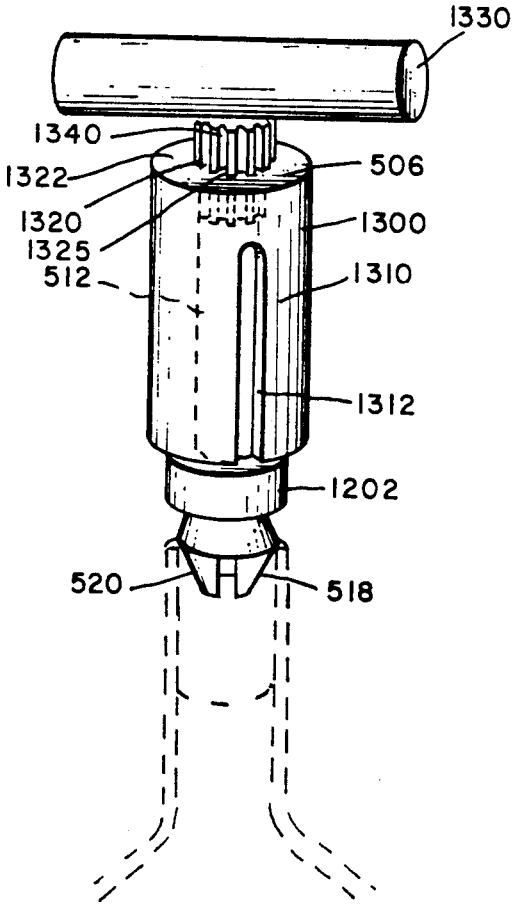
Fig. 16.
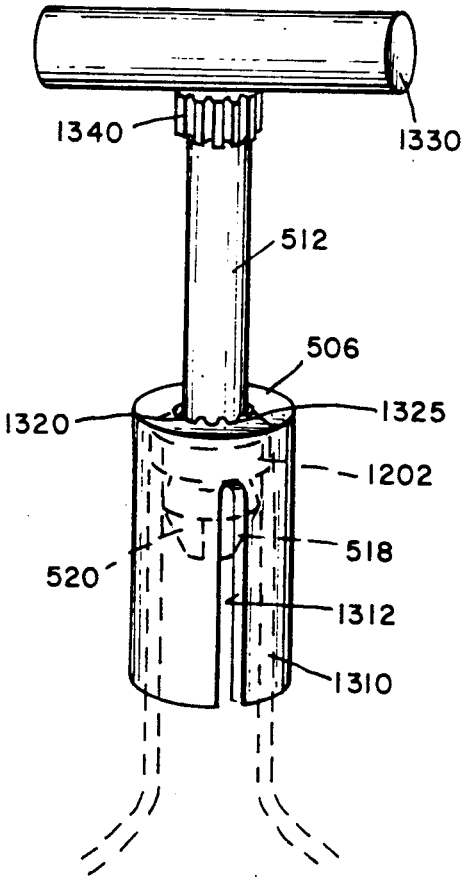

APPARATUS FOR REMOVING A SOFT STOPPER FROM A CONTAINER

This application is a continuation-in-part of co-pending application Ser. No. 07/401,186 filed on 08/31/89 and now U.S. Pat. No. 4,916,985.

BACKGROUND OF THE INVENTION

1. Field of the Invention

The present invention relates to apparatus which are used to remove a soft stopper such as the cork from a container such as a bottle of wine.

2. Description of the Prior Art

Many liquid containers have stoppers made of cork to prevent spillage during transportation and to preserve the liquid contents during prolonged storage. For example, alcoholic beverages such as wines are often stored in long neck glass bottles which are stoppered by corks allow the wine to breathe and sometimes add flavor to the wine. To remove the cork, typically a corkscrew is used to bore a hole in the middle of the cork to be pulled out of the bottle neck. However, there are many disadvantages to the conventional corkscrew and there exists a need for a safe and effective tool to grip the cork for removal from a bottle.

The typical corkscrew consists of a long solid screw which is connected to a handle usually arranged perpendicular to the longitudinal axis of the screw to facilitate the rotational effort by the user's hand in screwing the screw into the cork and for pulling the cork out of the bottle.

Several disadvantages of prior art corkscrews are as follows:

(1) The screw has a distinct sharp point which can easily puncture or lacerate the user or another person;

(2) There is no structural design to assist the screw to center itself so as not to puncture one side of the cork before the entire longitudinal length of the cork is traversed for maximum friction between the cork and the screw. There is also no structural design to insure that once the top of the cork is punctured, (whether at the center of the top surface of the cork or not), that the direction of penetration is parallel to the central longitudinal axis. The screw is particularly prone to travel in several different directions if the user cannont steady his or her hand at all times during the screwing motion. When this happens, the cork is particularly prone to breakage;

(3) Even if the center is punctured and the subsequent direction of the screw is exactly along the longitudinal axis of the cork, some corks are so soft that on pulling, the center of the cork disintegrates and allows the screw to come out of the cork without the cork being pulled out of the bottle neck;

(4) Once the cork has a complete bore in the center, there is no way another attempt with the same screw will succeed in removal of the cork because the threads of the screw no longer can form any tight contact and friction with the body of the cork. To retrieve the liquid, one has to either push the broken cork into the bottle or break the glass container itself, both methods introducing contaminants into the wine;

(5) The major obstacle to the removal of the cork is the friction between the cylindrical surface of the cork and the interior of the bottle neck surrounding the cork. To attempt to overcome this friction by using the friction between a narrow straight slippery metal screw at the center of the cork, in loose contact with the body of a soft screw, is a most ineffective approach. This approach tends to break the cork rather than overcome the friction between the cork and the bottle neck.

Therefore, there is a significant need for an improved cork removal apparatus which overcomes the disadvantages of the prior art corkscrews.

SUMMARY OF THE PRESENT INVENTION

The present invention is an apparatus for removing a soft stopper such as a cork or rubber stopper from a container which operates by gripping the cork from the circumferential surface toward the center. Through this process, a continuous centering and stabilizing mechanism is provided which allows less tiring effort and skill from the user. Through use of the present invention, the integrity of the cork is preserved while it is being pulled out of the bottle neck. The present invention also does not create any holes inside the body of the cork as caused by conventional corkscrews. This tool is not sharp and the threads of the gripping mechanism are directed inward and hidden from the user, whereby the user cannot harm himself. The unsymmetrical design of the cross-section area of the gripping mechanism allows easy insertion of the tool but maximum friction with the cork while it is being pulled out. The tool shears the cork from the interior surface of the bottle neck, attacking the areas where most friction occurs, thus facilitating removal of the cork.

The invention is new and unique because it can be used on corks, or other soft stoppers that are new and untouched as well as on corks that have been damaged by conventional corkscrews, with a hole in the center that is coming apart. No other tools, including the conventional corkscrew, are designed to grip and pull out damaged corks as well as new corks.

It has been discovered, according to the present invention, that the use of a cylindrical object whose diameter is slightly larger that the diameter of a cork, or other soft stopper and which contains threads on its interior surface enables the apparatus to be inserted between the exterior surface of the cork, or other soft stopper and the adjacent interior surface of the container into which the cork has been embedded, thereby creating a cork removal apparatus which removes the cork by the force of the internal threads compressing the cork and driving it out of the container, as opposed to puncturing the cork.

It has further been discovered, according to the present invention, that the use of a cylindrical object whose diameter is slightly larger that the diameter of a cork, or other soft stopper and which contains threads on its interior surface enables the apparatus to compress the cork while removing it, thereby enabling the user to utilize the present invention with corks that have been damaged and sheared in addition to new corks.

It has additionally been discovered, according to the present invention, that the use of a hinge along the length of the cylindrical object enables the object to be opened to thereby facilitate removal of the cork after it has been pulled from the bottle.

It has been additionally discovered that different wine bottles, for example, vary in the internal diameters of the bottle necks. Often, even the internal circumference of an individual bottle neck is not exactly circular, but the bottle neck would have diameters varying from 0.710 inches to 0.745 inches. Therefore, the apparatus has to have a cylindrical structure pliable enought to fit into the varying dimensions of the bottle neck and yet strong enough to grip the cork out of the bottle neck.

It has been additionally discovered that a threaded collar which can be slid downwards along the cylindrical structure which has a tapered outside diameter will allow the collar when progressively slid downwards to compress progressively the bottom wedges of the cylindrical structure. This will allow the user to adjust the diameter of the bottom wedges of the cylindrical sturcture to a given cork before its extraction from the bottle.

It has been further discovered that a flat bottom at the bottom of the cylindrical structure will allow insertion of the cylindrical structure just as easily as one with one side longer than the other, as previously discribed in co-pending application Ser. No. 07/401,186. The flat bottom will allow all portions of the bottom of the cylindrical structure to be in contact with the cork before the apparatus is screwed into the area between the cork and the bottle neck. This allows a close fit between the apparatus and the bottle neck, whether parts of the bottle neck are slightly larger or slightly smaller than the apparatus prior to the apparatus being firmly pressed onto the bottle-cork contact area.

It has been additionally discovered that the internal threading structure interior to the cylindrical structure can have more than one thread which runs continuously (except where it has been interrupted by the slit cut into the longitudinal length of the cylinder). For example, two threads can start from the bottom of the cylinder at the same level (e.g. within one millimeter from the bottom of the cylinder) but at opposite points on the circumference of the cylinder (for example, FIG. 8, at twelve o'clock and at six o'clock position). These two threads will wind up the interior of the cylinder at the same pitch but will be exactly opposite to each other at any cross-sectional segments of the cylinder. The advantage will be twice the gripping friction on the circumferential surface of the cork at all levels of the cork compared to an apparatus with only one thread (e.g. FIG. 7*a* which has a thread starting at 12 o'clock at the bottom of the cylindrical structure). For a harder stopper, which requires more gripping friction to pull it from the bottle neck, three of four threads may be desirable, and the threads will start respectively at twelve, four, eight o'clock positions (for example as in FIG. 7*b*), or twelve, three, six, and nine o'clock positions (for example as in FIG. 8), etc.

In view of the great variability of the dimensions of the bottles, it has been additionally discovered that more than one longitudinal slit is advantageous to allow an even and tight fit between the cylindrical structure of the apparatus and the cork-bottle contact area.

It has also been discovered that the handle of the apparatus does not have to be perpendicular to the cylinder, but can be in a same direction as the cylinder, comparable to the handle of a knife the blade of the knife. This allows a more natural position for the hand and elbow and allows easier and better performance from the user.

It has also been discovered that after extraction of the top approximately half inch of cork from the bottle, should the user bend the cork, the cork will break and leave the remainder of the cork still embedded in the bottle. A stabilizer sheath is therefore desirable to ensure that during extraction of the cork, the direction of extraction does not deviate from the longitudinal axis of the bottle. This stabilizer sheath should have a corrugated inner diameter which will allow it to be temporarily attached to a location near to the handle without rotating when the compressor-collar is rotated to adjust the diameter of the wedges to adapt to the cork. The internal diameter of the bottom of the sheath should be larger than the external diameter of the compressor collar to allow the sheath to pass over the compressor collar. The stabilizer sheath can be slid all the way downwards to cover part of the outside surface of the bottleneck. The sheath is long enough for the left hand of the right handed user to grab the bottle neck together with the stabilizer sheath, while the right hand is used to rotate the handle which drives the wedges into the area between the cork and the inner surface of the bottle neck. After maximal penetration of the wedges into the cork-bottle-area, continuous rotation of the instrument will extract the cork as described, while the stabilizer sheath, held closely to the bottle neck, will ensure that the cork will be extracted straight out of the bottle instead of being bent or cracked by the unskilled user during the process.

It is therefore an object of the present invention to provide a cork, or other soft stopper removal apparatus which grips the cork from the exterior surface and squeezes it inwardly, thereby resulting in a compressive force on the cork. This enables the cork to be removed even if it is damaged because of the puncturing operation created by conventional cork removal corkscrews.

It is another object of the present invention to provide a cork, or other soft stopper removal apparatus which eliminates the sharp point of conventional corkscrews, thereby substantially reducing the likelihood of injury to the user.

It is a further objecr of the present invention to provide a cork, or other soft stopper removal apparatus which stabilizes the cork, as it is removed from its container, thereby reducing the likelihood that the cork will break apart during removal.

It is an additional object of the present invention to provide a cork or other soft stopper remover which is flexible and pliable so that it can accommodate various cork and bottle diameters.

It is another object of the present invention to provide enhanced gripping features which serve to better grip the cork or other soft stopper and enhance its removal from the bottle.

It is another object of the present invention to provide a stabilizing structure which serves to assure that during penetration of the instrument and the subsequent extraction of the cork, the cork is not bent in such a way to break into two parts.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a side elevational view of one embodiment of the present invention apparatus for removing a cork, or other soft stopper from a container.

FIG. 2 is a rear elevational view of the embodiment of the present invention apparatus for removing a cork or other soft stopper from a container, illustrated in FIG. 1.

FIG. 3 is a cross-sectional view taken along line 3—3.

FIG. 4 is a side-elevational view of a second embodiment of the present invention apparatus for removing a cork, or other soft stopper from a container, in the opened position.

FIG. 5 is a cross-sectional view taken along line 5—5 of FIG. 4.

FIG. 6 is a perpective view of an alternative embodiment of the present invention having three longitudinal slits with a single internal thread in the structure.

FIG. 7*a* is an illustration of a single internal thread in the cork or soft stopper remover which has three slits in the cylindrical structure.

FIG. 7*b* is an illustration of three internal threads 120 degrees apart in the cork or soft stopper remover which has three slits in the cylindrical structure.

FIG. 8 is an illustration of two internal threads 180 degrees apart in the cork or soft stopper remover which has four slits in the cylindrical structure.

FIG. 9 is a cross-sectional view taken along line 9—9 of FIG. 6.

FIG. 10 is a perspective view of another alternative embodiment of the present invention having four longitudinal slits with two internal threads in the structure.

FIG. 11 is a perspective view of an interior spreader member.

FIG. 12 is a cross-sectional view taken along line 12—12 of FIG. 10.

FIG. 13 is a perspective view of another alternative embodiment of the present invention having a slidable collar on the handle which can be slid toward the bottom of the apparatus to reduce the diameter of the bottom of the cylindrical structure of the apparatus.

FIG. 14 is a cross-sectional view taken along line 14—14 of FIG. 13.

FIG. 15 is a perspective view of the stabilizer sheath included with the present invention, with the stabilizer sheath in the upper most position.

FIG. 16 is a perspective view of the stabilizer sheath included with the present invention, with the stabilizer sheath in the down position where it covers part of the outside surface of the bottleneck to enable the user to stabilize the apparatus to the bottleneck.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 1, the present invention apparatus for removing a cork from a container 100 comprises a handle or hand gripping means 110 connected through a throat member 160 to a hollow cylindrical structure 120. The hollow cylindrical structure 120 has a longer side 112 and a shorter side 114. The shorter side 114 further comprises a longitudinal slit 140. By way of example, the overall length of the apparatus 100 may be approximately 12 centimeters and the width of slit 140 may be approximately 0.4 centimeters. The wall of the cylinder 120 should be thin, for example approximately 0.1 centimeter or less and made of sturdy material such as strong plastic or metal. As illustrated in FIG. 1, the longer side 112 of the cylinder 120 exceeds the shorteer side 114 by a distance "X" which by way of example can be approximately 0.5 centimeter. This allows the tip 130 of the cylinder 120 to be pushed into the area between the circumferential surface of the cork and the interior of the bottle for the purpose of steadying the tool and aligning the center of the hollow cylinder 120 with the center of the cork in a direction parallel to the longitudinal axis of the cork. The external diameter of the cylinder 120 is z (which by way of example may be approximately 1.8 to 2 centimeters). The slit 140 allows the cylinder 120 to open up upon insertion of the tip 130 to wedge part of the cork away from the bottleneck and to permit the tool to grip corks which are slightly larger than 1.8 to 2 cm in diameter. If the corks are smaller in diameter than 1.8 to 2 cm, upon insertion of tip 130 to the contact area between the cork and the bottle neck, the cylinder 120 will also accommodate itself to this smaller cork.

For ease of insertion into the area between the external circumferential surface of the stopper and the interior surface of the container neck, the tip 130 is tapered, with the sharp edge near the external surface of the apparatus. Similarly, the edges of the apparatus forming slit 140 along the entire length of the slit are tapered with the sharp edges near the external surface of the apparatus.

The cylinder 120 also has a broken ring 150 which is broken at the location of the slit 140 to thereby allow the slit 140 to continue uninterrupted. The broken ring 150 is fixed on the outer surface of the cylinder 120 at a distance of Y from the tip of the cylinder 130. By way of example, the distance Y may be approximately 1 to 2 centimeters. This ring should be made of hard material which has minimal friction with glass or the material making the top surface of the bottle neck. Other fancy structures such as ball bearings can be fitted here as additional ways to decrease friction between the tool and the top surface of the container which surrounds the cork.

Referring to FIGS. 2 and 3, the interior surface 250 of the cylinder 120 further comprises a spiral wound thread 261 formed into it and extending into the interior space of the cylinder 120. As illustrated in FIG. 3, the spiral thread 261 starts at the level 260 which is at the level of the short length 135 of cylinder 120 and continues up the interior surface 250 towards the connecting throat 160 which is narrower than the cylinder 120 to allow a firm and comfortable grip of the handle 110. The spiral direction of the threads 261 can be right-handed or left-handed to suit both types of users.

Referring to FIG. 3, it can be seen that the wedge near the tip 130 of the longer length of the cylinder 120 and the tip 135 of the shorter length of the cylinder are designed such that the outer surface 240 of the cylinder 120 is straight and the inner surface 250 is tapered to squeeze the cork toward its own center. The squeezing of the cork preserves the intactness of the cork so that no broken pieces fall inside the container and also increases the friction applied onto the cylindrical surface of the cork. The lower end 260 of the thread 261 starts at the level of 135 and winds it way up to 320 which is about 1 centimeter beyond the level of the ring 150. As illustrated in FIG. 3, the threads 261 are not symmetrical in cross-section but flat on the top surface 262 to exert maximum pulling force on the cork to twist it upwards.

In addition, the cross-sectional surfaces of all of the threads 261 exposed at the advancing edge as well as the trailing edge of slit 140 must be reduced to a minimum, and ideally sharp. The advancing edge of the slit 140, as contrasted to the trailing edge, is the edge that will be pushing against the cork when the apparatus is rotated. The reason for making the exposed threads at this advancing edge into sharp edges is due to the softness of the cork or soft stopper being removed which allows its partially and slightly cut surface (from the threading of the threads 261 into the body of the cork) to be recompressed together at the site of slit 140 after the trailing edge has passed. If the exposed surface of the threads at the advancing edge are not sharp, the blunt wedge shape of the cross-sectional area of the threads will break the circumferential surface of the cork or soft stopper when the apparatus is rotated. Likewise, the trailing edge thread surfaces should also be sharp so that the surface of the cork or soft stopper will not break on its removal from the apparatus.

After the insertion of the tip of the cylinder to wedge between the cork and the bottle neck, initial turning motions of the apparatus 100 will bring the apparatus 100 down in a direction toward the bottom of the container. After about 1 to 2 centimeters penetration, the broken ring 150 will not allow the cylinder 120 to move further down toward the bottom of the container. As the apparatus 100 is screwed into the bottle, the threads 261 are screwed into the exterior surface of the cork. After the apparatus 100 has been screwed into the bottle to its maximum penetration (when the broken ring 150 reaches the top of the container), further continuous turning motion of the cylinder 120 in the same direction will instead twist the cork upwards in a direction away from the bottom of the container because the flat upper surface 262 of threads 261 will cause the cork to be moved upwardly out of the container. This will allow the cork to be removed from the bottle or container neck without the right-handed user physically holding with the left hand onto the bottle or container and trying with the right hand to pull the cork from the bottle or container. The left hand merely steadies the bottle or container while the right hand turns the apparatus, always in the same direction, which is easier to perform and prevents breaking the glass container. The connection between the handle 110 and the cylinder 120 at 160 should be of a thickness to allow a comfortable grip between the user's second and third fingers while the hand is holding the handle 110.

As the top of the cork moves from 135 toward 320, the bottom of the cork also moves towards 320. The distance between 135 and 320 should be such that when the top of the cork reaches 320, the bottom of the cork has not entered the cylindrical structure, but enough of the cork has entered the cylindrical structure to allow easy removal of the remainder portion of the cork still embedded in the bottleneck. The limited penetration of the cylindrical structure into the bottleneck by virtue of the ring structure allows the lower part of the cylinder 120 to be easily be slid out from the bottle neck. After complete extraction of the cork from the bottle, the portion of cork sticking out of the cylindrical structure of the apparatus allows the cork to be unscrewed and removed from the apparatus to be used to restopper the bottle. The shaded area of 330 represents solid material, in contrast to the hollow interior 340 of the cylinder 120.

The embodiment can therefore be defined as an apparatus for removing a cork from a container, comprising: (a) a thin walled hollow generally cylindrical body having a first side which is longer than its opposite second side thereby terminating in a bottom extending at an upward angle from the lower tip of the first side to the lower tip of the second side; (b) a handle member attached to said neck member at a location remote from the top of the thin walled hollow generally cylindrical body; (c) a longitudinal slit in the wall of said thin walled hollow generally cylindrical body extending from the lower tip of the second side for most of the length of the body; (d) a fixed broken ring extending around the circumference of said thin walled hollow generally cylindrical body at a location remote from the bottom of the body, the break in the ring aligned with the longitudinal slit in the wall of the thin walled hollow generally cylindrical body; and (e) an inwardly extending spiral thread extending from the interior surface of said thin walled hollow generally cylindrical body and winding from the bottom of the body upwardly beyond the location of said broken ring.

The wall of said thin walled hollow generally cylindrical body is inwardly tapered adjacent its bottom.

The inwardly extending spiral thread further comprises a flat upper surface and sharp edges along the leading and trailing edges of the slit.

An alternative embodiment of the present invention is illustrated in FIG. 4. All of the features discussed in the embodiment apparatus 100 are also present in this alternative embodiment apparatus 400. Therefore, the parts are numbered the same. There are two modifications which differentiate the alternative apparatus 400. The first modification is the addition of a hinge 170 which is located along the length of the cylinder 120 at a location exactly opposite to the slit 140. The second modification is the addition of moveable collar 180 which fits tightly onto the connecting neck 160 and threaded thereon through threads 171. As illustrated in FIG. 4, this alternative apparatus is divided into two halves 410 and 412 which can be separated into the opened position by the hinge 170. For the operation of removing the cork from the bottleneck, the two halves 410 and 412 are placed together so that the alternative apparatus 400 resembles the first embodiment apparatus 100 as illustrated in FIG. 1 and the collar 180 will be in the down, tight fitting position, so that the two halves along the hinge (410, 412 respectively) will form a hollow cylinder with a narrow slit 140. After removal of the cork from the bottleneck as previously described, the cork will have moved into the interior of the cylinder 120. To retrieve the cork, the collar 180 will be slid upwards, to allow the two halves of the cylinder wall, 410 and 412 to open up and expose the cork, which can now be picked up easily from the opened cylinder. The hinge should ideally be thin and unobstructive to the rotational movement of the cylinder during removal of the cork from the bottle neck. Ideally, if the tool is made of hard plastic, the hinge will represent a thinned out area in the shape of a narrow line which is flexible and durable without breakage even after multiple bending and flexing. During operation, the tight fitness between the cork and the bottle neck will prevent excessive wobbling of the hinge and thus protect it from tearing easily.

In summary, the present invention is an apparatus for removing a cork, or other soft stopper from a container such as a bottle. The apparatus includes a hollow cylinder having a slit along its length and a handle attached to the top of the cylinder. The interior surface of the cylinder includes a spiral wound thread having a flat upper surface. The cylinder is inserted between the outer circumference of the cork and the interior wall of the bottle and is rotated so that the threads are embedded in the outer wall of the cork, or other soft stopper and serve to compress the cork inwardly as the apparatus is screwed into the container. A stop ring serves to limit the penetration of the apparatus into the bottle and when the apparatus has reached its maximum penetration, the apparatus begins to force the cork out of the bottle as the turning motion of the cork continues in the same direction. In one alternative embodiment, the cylinder includes a hinge which permits the two halves of the cylinder to be opened after the cork is removed from the bottle to thereby enable the cork to be removed from the opened cylinder.

The first alternative embodiment of the present invention can be defined as an apparatus for removing a cork, or other soft stopper from a container, comprising: (a) a two piece thin walled hollow generally cylindrical body longitudinally divided in half and each half connected by a hinge forming a generally cylindrical shape when the two halves are placed together; (b) said two piece thin walled hollow generally cylindrical body having a first side which is longer than its opposite second side thereby terminating in a bottom extending at an upward angle from the lower tip of the first side to the lower tip of the second side; (c) the top of the two piece thin walled hollow generally cylindrical body extending into a neck member; (d) a handle member attached to said neck member at a location remote from the top of the two piece thin walled hollow generally cylindrical body; (e) a longitudinal slit in the wall of said two piece thin walled hollow generally cylindrical body extending from the lower tip of the second side for most of the length of the body; (f) a longitudinal hinge in the wall of said two piece thin walled hollow generally cylindrical body extending from the lower tip of the first side for the entire length of the body to enable the two pieces to be rotated relative to one another by the longitudinal hinge; (g) a fixed broken ring extending around the circumference of said two piece thin walled hollow generally cylindrical body at a location remote from the bottom of the body, one break in the ring aligned with the longitudinal slit in the wall of the two piece thin walled hollow generally cylindrical body and a second break in the ring to allow opening of the two pieces along said longitudinal hinge; (h) a slidable collar located on said neck member for retaining the two halves of the two piece thin walled hollow generally cylindrical body together; and (i) an inwardly extending spiral thread extending from the interior surface of said two piece thin walled hollow generally cylindrical body and winding from the bottom of the body upwardly beyond the location of said broken ring.

Several additional alternative embodiments of the present invention provide additional enhancements to achieve improved performance and efficiency. Referring to FIGS. 6 and 9, one such additional alternative embodiment apparatus for removing a cork or soft stopper from a container is illustrated at 500. The second alternative apparatus 500 comprises a body member 512 which is preferably generally cylindrical. The body member 500 has an upper body length "L" which is sufficiently long to be grasped in one hand and by way of example may be approximately 4 inches. Body member 512 also comprises a transverse opening 516 therethrough adjacent its upper end. The transverse opening is designed to accommodate a generally cylindrical bar member so that a cross-piece may be inserted to form a transverse handle if desired, comparable to handle 110 of the first embodiment apparatus 100. Body member 512 further comprises a multiplicity of longitudinal slits 524 which extend from the lower tip to a location within the longitudinal mid area of the body member. The longitudinal slits serve to divide the lower body into a multiplicity of penetrating wedges at the lower end of the apparatus 500. In the illustration in FIGS. 6 and 9, the apparatus 500 have three longitudinal slits 524 which serve to form three penetrating wedges 518, 520, and 522 which are equal distance from broken ring 514 and which allows body member 512 to stand up straight as if on the three legs of a tripod. At a location along the longitudinal length of the body 512 a horizontal split ring 514 is positioned. The ring 514 is also cut by the longitudinal slits 524. Referring to FIG. 9, the cylindrical body 512 is hollow in order to accommodate the cork or soft stopper. The body 512 has an interior cavity 826. An optional feature is a centrally disposed longitudinal blocking member 820 which extends from the top 824 of interior cavity 826 to a location within the interior cavity and above the split ring 514.

In the preferred configuration for this apparatus 500, the thickness "T" of the cylinder wall 526 is approximately 0.1 inches and the external diameter "D" a cylinder body 512 is approximately 1.0 inches, plus or minus 0.2 inches, and the external diameter of the bottom of the cylindrical structure "E" is 0.74 inches plus or minus 0.04 inches, and the thickness of the wedges "W" is approximately 0.020 inches.

The interior surface of the cylinder body beginning at the lower tip of each penetrating wedge and continuous to a location within interior cavity 826 comprises at least one spiral thread. The spiral thread 550 starts adjacent the lower tip of one of the penetrating wedges and continues up the interior surface of all three penetrating wedges and into the interior surface of the body within cavity 826. The spiral thread 550 continues for a distance beyond ring member 514. The direction of the threads can be right-handed or left-handed to suit both types of users. Preferably, the pitch of the thread 550 is in the range of 2 to 5 turns per inch. The horizontal extention "e" of thread wedges into the interior of cylinder body 512 are in the range of approximately 0.030 inches to approximately 0.080 inches. The height "f" of the thread wedges are in the range of 0.050 inches to 0.090 inches. Preferably, the distance "d" between the bottom of ring 514 and the lower tip of the wedge sections is approximately 0.5 inches, plus or minus 0.2 inches.

The gradient of the threads cutting into the circumferential surface of the cork will also affect the gripping power of the apparatus. The gradient is defined as the distance the cork travels (or is pulled out of the bottle) per turn of the apparatus divided by the horizontal distance cut by the screw on the surface of the cork. The flatter the gradient created by an apparatus, the firmer the thread holds onto the cork, and the distance through which the cork has been pulled out of the bottle per turn of the apparatus is very small. Consequently, the threads are less likely to break the cork apart from the pulling component of the extraction force. Conversely, if the gradient is very sharp, the cork has to move a longer distance out of the bottle with every turn of the apparatus and is more likely to disintegrate.

Since it is of advantage to pull the cork out of the bottle with as few turns of the apparatus as possible without breaking the cork, the cylindrical structure of this apparatus offers a distinct advantage compared to the conventional narrow straight solid screw. The gradient of the conventional screw can be calculated as follows: the conventional cork screw has five turns in a distance of approximately 2 inches. This means the cork advances 0.4 inches for every turn of the corkscrew. The diameter of the screw at the widest portion is about 0.25 inches, which means a circumference of 0.79 inches. Therefore the gradient is 0.4 inches divided by 0.79 inches, which is 0.506. In contrast, the smallest diameter of the threads inside the cylindrical structure of this apparatus is approximately 0.58 inches. If the threads also are designed to have five turns per two-inch advancement of the cork, the gradient will be only 0.4 inches divided by ($3.14\times2\times0.29=1.82$), which is only 0.220. This means that if one wants a pitch with the same potential of breaking corks during extraction, i.e. a gradient of 0.506, one can have a cylindrical structure with far fewer turns inside. The number of turns needed would be 2 inches divided by ($0.506\times3.14\times2\times0.29$) inches=2.17 turns. This means the cork can be extracted with only 2.17 turns of the apparatus without greater risk of breakage of the cork as compared to the conventional corkscrew. In reality, it is not necessary to completely remove the cork with less than three turns, and therefore this apparatus can extract the cork with the combined advantage of less turns with more cork-intactness as compared to the conventional corkscrew.

It is within the spirit and scope of the present invention to have at least one spiral thread 550 and preferably as many as three such spiral threads. The internal threading structure interior to the cylindrical structure can have more than one thread which runs continuously (except where it had been interrupted by the slit cut into the longitudinal length of the cylinder). FIG. *7a* illustrates a configuration having one spiral thread which is a right handed thread beginning at the 12 o'clock position. FIG. *7b* illustrates a configuration where there are three spiral threads beginning 120 degrees apart on the interior surface of the cylinder body. FIG. 8 illustrates a configuration where there are two spiral threads on the interior surface of a cylinder body. In this case one spiral thread starts at the 12 o'clock position and one spiral thread starts at the 6 o'clock position. The two threads can start from the bottom of the cylinder at the same level (e.g. within one millimeter from the bottom of the cylinder) but at opposite points on the circumference of the cylinder. These two threads will wind up the interior of the cylinder at the same pitch but will be exactly opposite to each other at any cross-sectional segments of the cylinder. The advantage will be twice the gripping friction on the circumferential surface of the cork at all levels of the cork compared to an apparatus with only one thread. For a harder stopper, which requires more gripping friction to pull it from the bottle neck, three or four threads may be desirable, and the threads will start respectively at twelve, four, eight o'clock positions, or twelve, three, six, and nine o'clock positions, etc.

Since the design of this apparatus allows the gradient to be doubled (from 0.22 to 0.44) without reaching the equivalence of cork-breakage potential of the conventional corkscrew (gradient 0.506), it is possible to place two threads as described above inside the cylindrical structure, thus increasing the pitch (for example from 0.4 inches to 0.8 inches) and doubling the area of contact (gripping friction) between the apparatus and the cork without increased potential of cork-breakage.

The leading edge 552 of thread 550 alongside each slit 530 must be sharp because the cork tends to recompress itself at locations corresponding to the slits. The leading edge is the edge of the slit which pushes against the cork when the apparatus is turned. The trailing edge 554 of the threads 550 also needs to be sharp to prevent breakage of the cork surface when cork is subsequently unscrewed manually from the interior of body 512.

The further the cork or soft stopper is wound into the apparatus 500, the more difficult it is for the cork to be removed from the apparatus. An additional enhancement is the inclusion of a stop block or rod member 820 which extends from the upper edge 824 of interior chamber 826 to a location within the interior chamber and above the ring 514. The stop block or rod 820 serves to limit the travel of the cork or soft stopper so that it will not go so far into the interior chamber that it cannot be retrieved.

In view of the great variability of the dimensions of the bottles, more than one longitudinal slit is advantageous to allow an even and tight fit between the cylindrical structure (in other words the penetrating wedges) of the apparatus with the area between the cork and the bottle neck. For example, if two threads were to start at the bottom of the cylinder at twelve and six o'clock position, four slits can be cut into the cylinder at 12-1, 3-4, 6-7 and 9-10 o'clock locations (e.g. FIG. 8, looking from top down in the direction of a right-handed-thread structure) so that the threads can imbed into the superficial area between the cork and the bottle neck before the apparatus is rotated to advance both threads down the deeper areas between the cork and the bottle neck.

Even with one thread starting at 12 o'clock and a second thread starting at 6 o'clock, three slits can be cut into the longitudinal length of the cylinder body 512. In fact an odd number of slits is preferred because having two slits on the exact opposite side of a cylindrical structure will weaken the structure. The width of the slits at the bottom should be wider than the width of the slits near the ring, to allow flexibility to fit into various cork sizes.

After insertion inside the area between the cork and the bottle neck for about 0.40 to 0.60 inches, the pressure between the cork and the bottle neck is such that it often will not allow further penetration. At this point, the bottom of the cylindrical structure is gripping the cork firmly enough for easy extraction of the cork out of the bottle for 0.4 to 0.6 inches. The portion of cork pulled out of the bottle neck will expand and push apart or spread the penetration wedges of the cylinder wall (with the slits allowing easy expansion of the diameter of the bottom of the cylindrical structure). It is not advised to continue to pull the cork out by brute force at this time since the majority portion of the cork is still inside the bottle neck and such attempts will break off the top 0.4 to 0.6 inches of the cork. At this time, the apparatus should continue to be rotated. The spreading of the cylindrical wall prevents the bottom of the apparatus to reenter the area between the cork and the bottle neck. Since at this time the threads have engaged the cork firmly, continued rotation of the apparatus will continue to extract the cork out of the bottle neck. Therefore, in this design, the bottom of the cylindrical structure will serve both as a first-penetration part as well as the structure to provide counter-traction to pull the remainder part of the cork out of the bottle.

The ring 514 on the outside of the cylinder prevents over penetration of the penetrating wedges. It also serves as a structure to limit the spreading of the bottom of the cylindrical structure on expansion of the portion of cork which is out of the bottle neck.

Whether the top 0.4–0.6 inches of the cork is first pulled out of the bottleneck or not, on continued rotation of the apparatus, the cork will migrate for up to one inch inside the interior of the cylindrical structure. Since the ring 514 on the outside of the cylinder severely restricts the expansion of the portion of the cylinder immediately around it, the cork is severely compressed in this top part. Therefore, it is advantageous to (1) make the diameter of the interior of the cylinder body 512 near the ring 514 to be slightly larger (e.g. 0.760 inches) than the diameter of the cylinder body 512 at the bottom where the wedge sections are located (e.g. 0.740 inches) and (2) to have the threads extend from the bottom of the cylinder to only about 0.75 inches high up within the interior of the cylinder and leave the interior wall above this level as a smooth surface to accommodate the top of the cork which has moved all the way up there.

Central stopping block or rod 820 is situated about 1 inch from bottom of the cylindrical body 512 to prevent over-penetration of the extracted cork into the interior of cylindrical structure, which will make removal of the cork from the apparatus very difficult.

Referring to FIG. 10, another alternative embodiment is to have four slits to thereby create four wedge sections 720, 722, 724 and 726 at the bottom area of cylinder body 700. The four wedge sections are comparable to the three wedge sections as previously discussed and illustrated in FIGS. 6 and 9. The four wedge section embodiment 700 also has at least one internal spiral thread 750 and may have two spiral threads or three spiral threads as previously discussed. One advantage of the four wedge section embodiment is that it has more flexibility than the three wedge section embodiment and so it is easier to force the wedges in the very tiny space between the cork and the bottle. A disadvantage of the four wedge section embodiment is that it is structurally weaker than the three wedge section embodiment and a wedge section can more easily be broken off. To strengthen the connection between the thin walled wedges to the body 712, the external diameter at 716 (e.g. 0.740 inches) is gradually expanded at 714 (to 0.790 inches for example), while the internal diameter at these respectivee locations remains constant (e.g. 0.700 inches). The external diameter of the portion of wedges from 716 to 718 remain constant (e.g. 0.740 inches).

It has been discovered that an additional umbrella structure can also assist the opening up of the structure around the area approximate one inch from the bottom of the cylinder body 712. While the umbrella structure 900 illustrated in FIGS. 11 and 12 is discussed in conjunction with the four wedge embodiment 700, it will be appreciated that it can also be incorporated into the three wedge embodiment. The umbrella structure 900 is constructed from a narrow cylinder approximately 0.25 inches in diameter, made of strong spring like material. Four slits are cut into 75% of the length of the cylinder and the four leaves 912, 914, 916 and 918 are opened up like of the four petals of a flower, or an inverted umbrella with the cylindrical tip 920 pointing toward the bottom. Such a structure can be inserted inside the interior of the apparatus cylinder body 712 with the cylindrical tip of the umbrella 900 situated at about 0.75 inches from the bottom of the cylindrical structure of the apparatus and the four leaves attached to the interior wall 726 of cylinder body 712 by attaching to four corresponding slots in the wall, (two of which are illustrated as 732 and 734 in FIG. 12) and inserting as respective leaf of the umbrella into a corresponding slot. The slots 732 and 734 are located approximately 1.5 inches from the bottom of the cylindrical body 712. When the top of the cork reaches to approximately 0.75 inches from the bottom of the apparatus, it will be in contact with the central down-pointing cylinder 920 of the umbrella 900. Further rotation of the apparatus will bring the cork higher, which will push the central part 920 of the umbrella 900 upwards. Since the four leaves of the umbrella are fitted on the wall of the apparatus cylinder and cannot move up but only outwards, the upward movement of the cork or soft stopper will create a force to open up the cylinder body 712 at the location near the top of the cork or soft stopper to accommodate the cork or soft stopper. However, before the top of the cork or soft stopper reaches the location, the cylinder body 712 will retain its original diameter so that no gripping pressure is lost on extracting the cork or soft stopper from the bottle neck.

In conjunction with the above, the structure used to limit the over penetration of the wedges into the bottle is also a broken ring structure 742. In one embodiment, the broken ring 742 may be only 0.4 inches from the lower tip as illustrated in FIG. 10, but it may also be further up along the length of the four wedges.

Such additional structures will help the retrieval of the cork partially buried inside the cylinder of the apparatus, by widening the diameter of the cylinder and by providing a force pushing the cork out of the cylinder.

Alternatively, as illustrated in FIGS. 13 and 14, the external diameter at the bottom of the apparatus, constituting the three or four wedges, can be constructed to be slightly larger than most cork diameters (e.g. 0.800 inches). The external diameter of the cylinder will have varying dimensions such that a movable collar 1202, when rotated downward through threads 1204 on the body 1218, will compress the widest portion (1210, which can be 0.820 inches in diameter), which in turn will compress the bottom of the apparatus to fit almost exactly the diameter of the cork (e.g. 0.740 inches) of any given bottle. After extraction of the cork out of the bottle, the movable collar 1202 can be moved upwards to release the compression on the cork to allow its easy removal from the interior of body 1218.

One problem which may arise after extraction of the top approximately half inch of cork from the bottle is that the user may bend the cork from side to side in order to try to more rapidly exact the cork from the bottle. If this is done, the cork probably with break at the location of the top of the bottle, thereby leaving the remainder of the cork still embedded in the bottle. An additional embellishment to prevent this problem is illustrated in FIGS. 15 and 16. The sheath 1300 is affixed to the top 506 of cylinder body 512 such that the generally cylindrical wall 1310 of sheath 1300 is concentric with the cylinder body 512. However, to accommodate this sheath, the top portion of the cylinder body is modified as illustrated in FIGS. 15 and 16 whereby the handle 1330 is now uppermost, comparable to the embodiment in FIG. 1 and a corrugated section 1340 is affixed beneath the handle 1330 and immediately above the cylinder body 512. The sheath 1300 comprises a pair of oppositely disposed longitudinal slits, one of which is illustrated at 1312. The sheath further comprises a central opening 1320 on its top 1322, which opening 1320 has serrations 1325 which intermesh to the serrations in the corrugated section 1340. The stabilizer sheath is therefore desirable to ensure that during extraction of the cork, the direction of extraction does not deviate from the longitudinal axis of the bottle. The corrugations or serrations 1325 in the opening 1320 of top 1322 allow the sheath 1300 to be temporarily attached through corrugated section 1340 to a location near to the handle 1330 without rotating when the compressor-collar 1202 is rotated to adjust the diameter of the wedges to adapt to the cork. The internal diameter of the bottom of the sheath should be larger than the external diameter of the compressor collar to allow the sheath to pass over the compressor collar 1202. The stabilizer sheath 1300 can be slid all the way downwards on body 512 to cover part of the outside surface of the bottleneck. The sheath is long enough for the left hand of the user to grab the bottle neck together with the stabilizer sheath, while the right hand is used to rotate the handle which drives the wedges into the area between the cork and the inner surface of the bottle neck. After maximal penetration of the wedges into the cork-bottle-area, continuous rotation of the instrument will extract the cork as described, while the stabilizer sheath, held closely to the bottle neck, will ensure that the cork will be extracted straight out of the bottle instead of being bent or cracked by the unskilled user during the process.

Therefore, defined broadly, the present invention is an apparatus for removing a soft stopper from a container, comprising: (a) an elongated thin walled hollow generally cylindrical body having a lower end which is open and extends into an interior chamber within the body which interior chamber is bounded by the interior wall of the body; (b) a multiplicity of spaced apart longitudinal slits in the wall of said elongated thin walled hollow generally cylindrical body extending from the lower open end for a portion of the length of the elongated body to divide the lower portion of the wall of the elongated thin walled hollow generally cylindrical body into a multiplicity of wedge sections separated from one another by a respective longitudinal slit; (c) an exterior fixed broken ring extending around the circumference of said thin walled hollow generally cylindrical body at a location along the length of said multiplicity of wedge sections, the breaks in the ring aligned with the longitudinal slits in the wall of the elongated thin walled hollow generally cylindrical body; and (d) at least one inwardly extending spiral thread extending from the interior surface of said thin walled hollow generally cylindrical body and winding from the lower tip of one wedge section across the interior surface of all wedge sections and onto the wall of the cavity within the body above the location of the fixed broken ring.

In one embodiment, said multiplicity of spaced apart longitudinal slits are three longitudinal slits spaced approximately 120 degrees apart to divide the lower portion of the body wall into three wedge shaped sections.

In another embodiment, said multiplicity of spaced apart longitudinal slits are four longitudinal slits spaced approximately 90 degrees apart to divide the lower portion of the body wall into four wedge shaped sections.

Each wedge shaped section may further comprise a sharp leading longitudinal edge and a sharp trailing longitudinal edge, with sharp cutting thread surfaces along both the leading and trailing edges.

In another embodiment, the apparatus comprises two inwardly extending spiral threads each beginning 180 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

To assist in preventing the soft stopper from going too deep into the container, the apparatus further comprises an interior rod extending from the upper interior edge for a portion of the length of the interior cavity and terminating at a location within the cavity and above the fixed broken ring.

The apparatus may further comprise a transverse opening extending through the elongated thin walled cylindrical hollow body at a location adjacent its upper end to accommodate a bar to be inserted through the opening to function as a transverse handle.

In an additional embellishment, the apparatus may further comrpise: (a) an interior umbrella shaped fixture having a cylindrical tip and a multiplicity of outwardly extending petals; and (b) the interior wall of said cavity further comprising a multiplicity of transverse slots at a location above said fixed broken ring to accommodate a respective one of said petals and cause said umbrella structure to extend within said interior cavity with its cylindrical tip facing the open lower end.

In another additional embellishment, the cylindrical body may further comprise threads and a threaded collar thereon. The threaded collar can be rotated downwardly to compress the bottom of the apparatus to fit the specific cork being removed and after extraction the threaded collar can be rotated upwardly on the cylinder to release the compressive force so that the cork can be removed. Although not required, in the preferred embodiment a rotational direction of the thread on the collar should be opposite to the rotational direction of the internal threads inside the wedges.

In another additional embellishment, there is added a stabilizing sheath which surrounds and is concentric with the elongated thin walled hollow generally cylindrical body and which is spaced apart from the body to surround the upper portion of the container as the soft stopper is being removed from the container to thereby prevent the soft stopper from breaking as it is being removed from the container.

The elongated thin walled hollow generally cylindrical body may be made of any suitable material such as metal or plastic.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms.

However, such detailed description is not intended in any way to limit the broad features or principles of the invention, or the scope of patent monopoly to be granted.

What is claimed is:

1. An apparatus for removing a soft stopper from a container, comprising:

a. an elongated thin walled hollow generally cylindrical body having a lower end which is open and extends into an interior chamber within the body which interior chamber is bounded by an interior wall of the body;

b. A multiplicity of spaced apart longitudinal slits in the wall of said elongated thin walled hollow generally cylindrical body extending from the lower open end for a portion of the length of the elongated body to divide the lower portion of the wall of the elongated thin walled hollow generally cylindrical body into a multiplicity of wedge sections separated from one another by a respective longitudinal slit;

c. an exterior fixed broken ring extending around the circumference of said thin walled hollow generally cylindrical body at a location along the length of said multiplicity of wedge sections, the breaks in the ring aligned with the longitudinal slits in the wall of the elongated thin walled hollow generally cylindrical body; and d. at least one inwardly extending spiral thread extending from the interior surface of said thin walled hollow generally cylindrical body and winding from the lower tip of one wedge section across the interior surface of all wedge sections and onto the wall of the cavity within the body above the location of the fixed broken ring.

2. An apparatus for removing a soft stopper from a container in accordance with claim 1 wherein said multiplicity of spaced apart longitudinal slits are three longitudinal slits spaced approximately 120 degrees apart to divide the lower portion of the body wall into three wedge shaped sections.

3. An apparatus for removing a soft stopper from a container in accordance with claim 1 wherein said multiplicity of spaced apart longitudinal slits are four longitudinal slits spaced approximately 90 degrees apart to divide the lower portion of the body wall into four wedge shaped sections.

4. An apparatus for removing a soft stopper from a container in accordance with claim 1 wherein each wedge shaped section further comprises a sharp leading longitudinal edge and a sharp trailing longitudinal edge.

5. An apparatus for removing a soft stopper from a container in accordance with claim 1 further comprising two inwardly extending spiral threads each beginning 180 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

6. An apparatus for removing a soft stopper from a container in accordance with claim 1 further comprising three inwardly extending spiral threads each beginning 120 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

7. An apparatus for removing a soft stopper from a container in accordance claim 1 further comprising an interior rod extending from the upper interior edge for a portion of the length of the interior cavity and terminating at a location within the cavity and above the fixed broken ring.

8. An apparatus for removing a soft stopper from a container in accordance with claim 1, further comprising a transverse opening extending through the elongated thin walled cylindrical hollow body at a location adjacent its upper end to accommodate a bar to be inserted through the opening to function as a transverse handle.

9. An apparatus for removing a soft stopper from a container in accordance with claim 1 further comprising:

a. an interior umbrella shaped fixture having a cylindrical tip and a multiplicity of outwardly extending petals; and b. the interior wall of said cavity further comprising a multiplicity of transverse slots at a location above said fixed broken ring to accommodate a respective one of said petals and cause said umbrella structure to extend within said interior cavity with its cylindrical tip facing the open lower end.

10. An apparatus for removing a soft stopper from a container in accordance with claim 1 further comprising threads on a portion of the exterior wall of the elongated thin walled hollow generally cylindrical body and a threaded collar rotatably affixed onto the threads, whereby the collar can be rotated toward said multiplicity of wedge shaped sections to compress them together.

11. An apparatus for removing a soft stopper from a container in accordance with claim 1 wherein each of said wedge shaped sections has a tapered wall with the taper extending from the location against the interior body cavity to the lower tip.

12. An apparatus for removing a soft stopper from a container in accordance with claim 1 wherein said elongated thin walled hollow generally cylindrical body is made of metal.

13. An apparatus for removing a soft stopper from a container in accordance with claim 1 wherein said elongated thin walled hollow generally cylindrical body is made of plastic.

14. An apparatus for removing a soft stopper from a container in accordance with claim 1 further comprising a stabilizing sheath which surrounds and is concentric with said elongated thin walled hollow generally cylindrical body and which is spaced apart from the body to surround the upper portion of the container as the soft stopper is being removed from the container to thereby prevent the soft stopper from breaking as it is being removed from the container.

15. An apparatus for removing a soft stopper from a container, comprising:

a. an elongated thin walled hollow generally cylindrical body having a lower end which is open and extends into an interior chamber within the body which interior chamber is bounded by the interior wall of the body;

b. three longitudinal slits in the wall of said elongated thin walled hollow generally cylindrical body spaced approximately 120 degrees apart and extending from the lower open end for a portion of the length of the elongated body to divide the lower portion of the wall of the elongated thin walled hollow generally cylindrical body into three wedge sections separated from one another by a respective longitudinal slit;

c. an exterior fixed broken ring extending around the circumference of said thin walled hollow generally cylindrical body at a location along the length of said three wedge sections, the breaks in the ring aligned with the longitudinal slits in the wall of the elongated thin walled hollow generally cylindrical body;

d. each wedge shaped section having a sharp leading longitudinal edge and a sharp trailing longitudinal edge; and e. at least one inwardly extending spiral thread extending from the interior surface of said thin walled hollow generally cylindrical body and winding from the lower tip of one wedge section across the interior surface of all wedge sections and onto the wall of the cavity within the body above the location of the fixed broken ring.

16. An apparatus for removing a soft stopper from a container in accordance with claim 15 further comprising two inwardly extending spiral threads each beginning 180 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

17. An apparatus for removing a soft stopper from a container in accordance with claim 15 further comprising three inwardly extending spiral threads each beginning 120 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

18. An apparatus for removing a soft stopper from a container in accordance claim 15 further comprising an interior rod extending from the upper interior edge for a portion of the length of the interior cavity and terminating at a location within the cavity and above the fixed broken ring.

19. An apparatus for removing a soft stopper from a container in accordance with claim 15, further comprising a transverse opening extending through the elongated thin walled cylindrical hollow body at a location adjacent its upper end to accommodate a bar to be inserted through the opening to function as a transverse handle.

20. An apparatus for removing a soft stopper from a container in accordance with claim 15 further comprising:

a. an interior umbrella shaped fixture having a cylindrical tip and a multiplicity of outwardly extending petals; and b. the interior wall of said cavity further comprising a multiplicity of transverse slots at a location above said fixed broken ring to accommodate a respective one of said petals and cause said umbrella structure to extend within said interior cavity with its cylindrical tip facing the open lower end.

21. An apparatus for removing a soft stopper from a container in accordance with claim 15 further comprising threads on a portion of the exterior wall of the elongated thin walled hollow generally cylindrical body and a threaded collar rotatably affixed onto the threads, whereby the collar can be rotated toward said three wedge shaped sections to compress them together.

22. An apparatus for removing a soft stopper from a container in accordance with claim 15 wherein each of said three wedge shaped sections has a tapered wall with the taper extending from the location against the interior body cavity to the lower tip.

23. An apparatus for removing a soft stopper from a container in accordance with claim 15 wherein said elongated thin walled hollow generally cylindrical body is made of metal.

24. An apparatus for removing a soft stopper from a container in accordance with claim 15 wherein said elongated thin walled hollow generally cylindrical body is made of plastic.

25. An apparatus for removing a soft stopper from a container in accordance with claim 15 further comprising a stabilizing sheath which surrounds and is concentric with said elongated thin walled hollow generally cylindrical body and which is spaced apart from the body to surround the upper portion of the container as the soft stopper is being removed from the container to thereby prevent the soft stopper from breaking as it is being removed from the container.

26. An apparatus for removing a soft stopper from a container, comprising:

a. an elongated thin walled hollow generally cylindrical body having a lower end which is open and extends into an interior chamber within the body which interior chamber is bounded by the interior wall of the body;

b. four longitudinal slits in the wall of said elongated thin walled hollow generally cylindrical body spaced approximately 90 degrees apart and extending from the lower open end for a portion of the length of the elongated body to divide the lower portion of the wall of the elongated thin walled hollow generally cylindrical body into four wedge sections separated from one another by a respective longitudinal slit;

c. an exterior fixed broken ring extending around the circumference of said thin walled hollow generally cylindrical body at a location along the length of said four wedge sections, the breaks in the ring aligned with the longitudinal slits in the wall of the elongated thin walled hollow generally cylindrical body;

d. each wedge shaped section having a sharp leading longitudinal edge and a sharp trailing longitudinal edge; and e. at least one inwardly extending spiral thread extending from the interior surface of said thin walled hollow generally cylindrical body and winding from the lower tip of one wedge section across the interior surface of all wedge sections and onto the wall of the cavity within the body above the location of the fixed broken ring.

27. An apparatus for removing a soft stopper from a container in accordance with claim 26 wherein each of said four wedge shaped sections has a tapered wall with the taper extending from the location against the interior body cavity to the lower tip.

28. An apparatus for removing a soft stopper from a container in accordance with claim 26 further comprising two inwardly extending spiral threads each beginning 180 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

29. An apparatus for removing a soft stopper from a container in accordance with claim 26 further comprising three inwardly extending spiral threads each beginning 120 degrees apart and each extending from the interior surface of said thin walled hollow generally cylindrical body and winding from the lower tip of a respective one wedge section across the interior surface of all wedge sections and onto the wall of the cavity within the body above the location of the fixed broken ring.

30. An apparatus for removing a soft stopper from a container in accordance claim 26 further comprising an interior rod extending from the upper interior edge for a portion of the length of the interior cavity and terminating at a location within the cavity and above the fixed broken ring.

31. An apparatus for removing a soft stopper from a container in accordance with claim 26, further comprising a transverse opening extending through the elongated thin walled cylindrical hollow body at a location adjacent its upper end to accommodate a bar to be inserted through the opening to function as a transverse handle.

32. An apparatus for removing a soft stopper from a container in accordance with claim 26 further comprising:

a. an interior umbrella shaped fixture having a cylindrical tip and a multiplicity of outwardly extending petals; and b. the interior wall of said cavity further comprising a multiplicity of transverse slots at a location above said fixed broken ring to accommodate a respective one of said petals and cause said umbrella structure to extend within said interior cavity with its cylindrical tip facing the open lower end.

33. An apparatus for removing a soft stopper from a container in accordance with claim 26 further comprising threads on a portion of the exterior wall of the elongated thin walled hollow generally cylindrical body and a threaded collar rotatably affixed onto the threads, whereby the collar can be rotated toward said four wedge shaped sections to compress them together.

34. An apparatus for removing a soft stopper from a container in accordance with claim 26 wherein each of said four wedge shaped sections has a tapered wall with the taper extending from the location against the interior body cavity to the lower tip.

35. An apparatus for removing a soft stopper from a container in accordance with claim 26 wherein said elongated thin walled hollow generally cylindrical body is made of metal.

36. An apparatus for removing a soft stopper from a container in accordance with claim 26 wherein said elongated thin walled hollow generally cylindrical body is made of plastic.

37. An apparatus for removing a soft stopper from a container in accordance with claim 26 further comprising a stabilizing sheath which surrounds and is concentric with said elongated thin walled hollow generally cylindrical body and which is spaced apart from the body to surround the upper portion of the container as the soft stopper is being removed from the container to thereby prevent the soft stopper from breaking as it is being removed from the container.

* * * * *